US006218067B1

(12) United States Patent
Belmont

(10) Patent No.: US 6,218,067 B1
(45) Date of Patent: Apr. 17, 2001

(54) TONERS CONTAINING CHARGEABLE MODIFIED PIGMENTS

(75) Inventor: James A. Belmont, Acton, MA (US)

(73) Assignee: Cabot Corporation, Boston, MA (US)

( * ) Notice: Subject to any disclaimer, the term of this patent is extended or adjusted under 35 U.S.C. 154(b) by 0 days.

(21) Appl. No.: 09/187,220

(22) Filed: Nov. 6, 1998

(51) Int. Cl.[7] ..... G03G 13/16; G03G 9/09; G03G 9/097

(52) U.S. Cl. ..... 430/126; 430/106; 430/106.6; 430/109; 430/110

(58) Field of Search ..... 430/106, 109, 430/110, 106.6, 137, 124, 126

(56) References Cited

U.S. PATENT DOCUMENTS

| | | | | |
|---|---|---|---|---|
| 3,968,044 | | 7/1976 | Tamai et al. | 252/62.1 |
| 4,291,112 | | 9/1981 | Lu | 430/110 |
| 4,522,909 | | 6/1985 | Narusawa et al. | 430/137 |
| 4,618,556 | | 10/1986 | Takenouchi | 430/110 |
| 4,640,882 | | 2/1987 | Mitsuhashi et al. | 430/110 |
| 4,902,570 | | 2/1990 | Heinemann et al. | 428/405 |
| 5,024,915 | | 6/1991 | Sato et al. | 430/106.6 |
| 5,116,712 | | 5/1992 | Nakamura et al. | 430/106 |
| 5,118,588 | * | 6/1992 | Nair et al. | 430/110 |
| 5,147,749 | | 9/1992 | Alexandrovich et al. | 430/110 |
| 5,270,770 | | 12/1993 | Kukimoto et al. | 355/274 |
| 5,275,900 | | 1/1994 | Ong et al. | 430/108 |
| 5,278,018 | | 1/1994 | Young et al. | 430/108 |
| 5,281,261 | | 1/1994 | Lin | 106/20 R |
| 5,283,149 | * | 2/1994 | Tyagi et al. | 430/106 |
| 5,432,035 | | 7/1995 | Katagiri et al. | 430/106 |
| 5,434,030 | | 7/1995 | Smith et al. | 430/106 |
| 5,484,575 | | 1/1996 | Steenackers | 422/176 |
| 5,484,675 | | 1/1996 | Tripp et al. | 430/106 |
| 5,486,420 | | 1/1996 | Nishihara et al. | 428/405 |
| 5,506,083 | | 4/1996 | Nash et al. | 430/106 |
| 5,510,221 | | 4/1996 | Matalevich et al. | 430/106.6 |
| 5,534,981 | | 7/1996 | Ohno et al. | 355/245 |
| 5,554,739 | | 9/1996 | Belmont | 534/885 |
| 5,561,018 | | 10/1996 | Moriya | 430/106.6 |
| 5,571,654 | | 11/1996 | Ong | 430/110 |
| 5,630,868 | | 5/1997 | Belmont et al. | 106/31.75 |
| 5,654,357 | | 8/1997 | Menashi et al. | 524/495 |
| 5,672,198 | | 9/1997 | Belmont | 106/20 R |
| 5,679,728 | | 10/1997 | Kawazura et al. | 523/215 |
| 5,695,899 | | 12/1997 | Kamada et al. | 430/106 |
| 5,698,016 | | 12/1997 | Adams et al. | 106/316 |
| 5,707,432 | | 1/1998 | Adams et al. | 106/31.6 |
| 5,713,988 | | 2/1998 | Belmont et al. | 106/31.6 |
| 5,749,950 | | 5/1998 | Mahmud et al. | 106/316 |
| 5,849,451 | * | 12/1998 | Ishihara et al. | 430/110 |
| 5,955,232 | * | 9/1999 | Little et al. | 430/106 |

FOREIGN PATENT DOCUMENTS

| | | |
|---|---|---|
| 0691 581 A2 | 1/1996 | (EP) . |
| 0 718 707 A1 | 6/1996 | (EP) . |
| 0 718 709 A1 | 6/1996 | (EP) . |
| 0 720 066 A1 | 7/1996 | (EP) . |
| 0 723 206 A1 | 7/1996 | (EP) . |
| 3-197961 | 8/1991 | (JP) . |
| WO 92/13983 | 8/1992 | (WO) . |
| WO 96/18688 | 6/1996 | (WO) . |
| WO 97/09655 | 3/1997 | (WO) . |
| WO 98/13418 | 4/1997 | (WO) . |
| WO 97/47382 | 12/1997 | (WO) . |
| WO 97/47691 | 12/1997 | (WO) . |
| WO 97/47692 | 12/1997 | (WO) . |
| WO 97/47697 | 12/1997 | (WO) . |
| WO 97/47698 | 12/1997 | (WO) . |
| WO 98/13428 | 4/1998 | (WO) . |

OTHER PUBLICATIONS

Diamond, A; ed. Handbook of Imaging Materials, Marcel Dekker, Inc., NY (1991), pp. 160–161. CAS File Registry No. 1309–38–2, Copyright 1999 ACS.*

Derwent Abstract Ace No. 91–298987/199141 of Japanese Patent 3–197972 (Pub Aug./1991).*

International Search Report for PCT/US98/15450.

International Search Report corresponding to International Appln No. PCT/US99/26110, filed Nov. 4, 1999.

* cited by examiner

*Primary Examiner*—Janis L. Dote

(57) ABSTRACT

A toner composition is disclosed which contains the product of the mixture of resin particles and chargeable modified pigment particles. The chargeable modified pigment particles comprise at least one organic ionic group attached to the pigment particle and at least one amphiphilic counterion. The amphiphilic counterion has a charge opposite to that of the organic ionic group. Developer compositions containing the toner compositions of the present invention and methods of imaging are also described which use the toner compositions of the present invention.

65 Claims, No Drawings

TONERS CONTAINING CHARGEABLE MODIFIED PIGMENTS

BACKGROUND OF THE INVENTION

1. Field of the Invention

The present invention relates to toner and developer compositions containing chargeable modified pigment particles.

2. Discussion of the Related Art

Electrophotographic processes and image-forming apparatus are currently widespread Particularly, aspects of the xerographic process are set forth in R. M. Schaffert "Electrography," the Focal Press, London & N.Y., enlarged and revised edition, 1975. In electrophotography, an image comprising an electrostatic field pattern (also referred to as an electrostatic latent image), usually of nonuniform sgth, is formed on an insulative surface of an electrophotographic element. The insulative surface comprises a photoconductive layer and an electrically conductive substrate. The electrostatic latent image may be formed by imagewise photo-induced dissipation of the strength of portions of an electrostatic field of uniform strength previously formed on the insulative surface. Typically, the electrostatic latent image is then visualized by contacting the latent image with an oppositely charged toner powder generally containing a colorant. This process of visualization of a latent image is known as development, and the composition containing the dry toner powder is known as the developer. The toned image is then transferred onto a transfer medium such as paper and fixed thereon by heating and/or pressure. The last step involves cleaning residual toner from the electrophotographic element.

Developer compositions used in dry electrophotography to visualize latent electrostatic images are divided into one-component systems composed of a dry toner powder, generally including a binder resin having a colorant dispersed therein, and two-component systems composed of a dry toner powder and carrier particles. Charge control agents are often melt mixed with the toner resin to control the chargeability of the toner during use. Known positive charge controlling compounds for use in dry toners are dye bases and salts thereof such as nigrosine dye base and salts. In order that toner compositions have process suitability in copying, they are required to be excellent in fluidity, anti-caking properties, fixability, chargeability, cleaning properties, and the like. To improve these properties, particularly fluidity, anti-caking properties, and chargeability, extraparticulate inorganic fine particles are frequently added to toner compositions. The components of the toner are dispersed or dissolved in the toner resin vehicle during the compounding step of the preparation process. The degree of dispersion has an effect on the performance of the toner material in the printing process. Inadequate dispersion can in many instances lead to a lack of consistency of homogeneity in the toner particle to particle. This can lead to a broad spread in charge distribution of the toner because of the dissimilarity of composition of the particulate toner. The electrostatic printing process is best performed when the toner used has a uniform charging behavior which will minimize the occurrence of print defects such as fogging, background, halloing, character spread, and dust contamination of the internal parts of the printing apparatus.

Development of a latent electrostatic image requires that a charge be developed on the toner particles prior to their deposition on the latent image, and that this charge be opposite to the charge of the latent image. All components of a toner, including binder resin, colorants, charge control agents, waxes and the like, can influence the development of charge on the toner particles. The influence of the colorants on the charging behavior of toner compositions is seldom considered, as there are few known methods to change and control the natural charging behavior of colorants such as carbon black. Thus an unmet need in dry toner technology is for pigments which have certain unique and predictable tribocharging properties.

One approach to meeting this need is to surface-modify known pigments to enhance or change their natural tribocharging properties. For example, Japanese Patent Application Hei 3[1991]-197961 relates to surface treatment of carbon blacks with amine-functional silane coupling agents which can, to some extent, overcome the natural tendency of carbon blacks to tribocharge negatively, which makes the carbon blacks more useful as pigments in positive-charging toners. However, it is believed that for such treatments to be effective, the silane coupling agents must form a covalent bond to the surface of the carbon black. The chemical groups believed to be present on the surface of normal carbon black are oxygen-containing groups. Silane coupling agents can form covalent bonds with these groups. Such groups are normally present on the surface of carbon black at low and poorly-controlled levels, making such treatment with silane coupling agents of limited scope and value.

SUMMARY OF THE INVENTION

A feature of the present invention is to provide alternative additives which impart or assist in imparting a positive or negative charge to the toner particles in toner and developer compositions.

Another feature of the present invention is to provide a colorant for use in toner and developer compositions.

Additional features and advantages of the present invention will be set forth in part in the description which follows, and in part will be apparent from the description, or may be learned by practice of the present invention. The objectives and other advantages of the present invention will be realized and attained by means of the elements and combinations particularly pointed out in the written description and appended claims.

To achieve these and other advantages and in accordance with the purpose of the present invention, as embodied and broadly described herein, the present invention relates to a toner composition which includes the product of the mixture of resin particles and at least one chargeable modified pigment particle, The chargeable modified pigment particle comprises at least one organic ionic group attached to the pigment particle and at least one amphiphilic counterion, wherein the amphiphilic counterion has a charge opposite to that of the organic ionic group.

The present invention also relates to a developer composition which includes carrier particles and the toner composition described above.

In addition, the present invention flier relates to a method of imaging which includes the steps of formulating an electrostatic latent image on a charged photoconductive imaging member, effecting the development thereof with a toner composition which includes the product of the mixture of: a) resin particles and b) at least one chargeable modified pigment particle, and thereafter transferring the developed image onto a suitable substrate. As described above, the chargeable modified pigment particle comprises at least one organic ionic group attached to the pigment particle and at least one amphiphilic counterion, wherein the amphiphilic counterion has a charge opposite to that of the organic ionic group.

It is to be understood that both the foregoing general description and the following detailed description are exemplary and explanatory only and are intended to provide further explanation of the present invention, as claimed.

DETAILED DESCRIPTION OF THE INVENTION

The present invention relates to toner and developer compositions which include the product of the mixture of resin particles and at least one chargeable modified pigment particle. The chargeable modified pigment particle comprises at least one organic ionic group attached to the pigment particle and at least one amphiphilic counterion, wherein the amphiphilic counterion has a charge opposite to that of the organic ionic group. By "chargeable" is meant that the modified pigment particle will alter or change the tribocharging characteristics of a toner formulation.

The pigment particles that are modified can be carbon black, cyan pigment, magenta pigment, yellow pigment, blue pigment, green pigment, brown pigment, violet pigment, red pigment, or mixtures thereof. Suitable pigments are pigment particles capable of being modified with attachment of at least one organic group that is positively or negatively chargeable. Carbon black is the preferred pigment and examples include, but are not limited to, commercially available forms of carbon black, such as those carbon blacks sold under the REGAL®, BLACK PEARLS®, ELFTEX®, MONARCH®, MOGUL®, and VULCAN® trademarks available from Cabot Corporation (such as BLACK PEARLS® 430, BLACK PEARLS® 700, BLACK PEARLS® 1000, BLACK PEARLS® 1300, Black Pearls® L, ELFTEX® 8, REGAL® 330, REGAL® 400, VULCAN® P), and will generally have a surface area between 25 $m^2/g$ and 1500 $m^2/g$ and a DBPA between 30 ml/100 g to 200 ml/100 g, and preferably a surface area between 25 $m^2/g$ and 600 $m^2/g$ and a DBPA between 30 ml/100 g to 150 ml/100 g. Other suitable carbon blacks include, but are not limited to, PRINTEX 40, PRINTEX 80, PRINTEX 300, PRINTEX L, PRINTEX U, PRINTEX V, SPECIAL BLACK 4, SPECIAL BLACK 5, FW200, (the foregoing available from Degussa Corporation), RAVEN 780, RAVEN 890, RAVEN 1020, RAVEN 1040, RAVEN 1255, RAVEN 1500, RAVEN 5000, RAVEN 5250 (the foregoing available from Columbian Chemical Corporation) and MA100 and MA44 available from Mitsubishi Chemical Corporation. Other pigments which may be capable of being modified are described, for instance, in U.S. Pat. Nos. 5,484,675; 5,571,654; 5,275,900; and EP 0 723 206 A1, all incorporated in their entirety by reference herein. As the pigment for black toner compositions, carbon black pigments alone or in combination with magnetite or blue, green, or black dyes can be used.

The chargeable modified pigment particle comprises at least one organic ionic group attached to the pigment particle and at least one amphiphilic counterion, wherein the amphiphilic counterion has a charge opposite to that of the organic ionic group. The organic ionic group can be attached to the pigment in varying amounts, i.e., low to high amounts, thus allowing fine control over charge modification. Preferably, the organic ionic group comprises at least one aromatic group, at least one $C_1$–$C_{20}$ alkyl group or mixtures thereof. The aromatic or alkyl groups may be further substituted with one or more ionic species, nonionic species or combinations thereof. In addition, the pigment particle may optionally include one or more substituted or unsubstituted nonionic aromatic groups, substituted or unsubstituted nonionic $C_1$–$C_{20}$ alkyl groups or combinations thereof. It is also preferred that the aromatic group or the $C_1$–$C_{20}$ alkyl group of the organic ionic group is directly attached to the pigment particles.

A preferred set of organic ionic groups attached to the pigment may be anionic or cationic in nature and include those groups described in U.S. Pat. No. 5,698,016, to Adams et al., the description of which is fully incorporated herein by reference. In addition, negatively charged organic ionic groups may be generated from groups having ionizable substituents that can form anions, such as acidic substituents or from salts of ionizable substituents. Preferably, when the ionizable substituent forms an anion, the ionizable substituent has a pKa of less than 11. The organic ionic group could further be generated from a species having ionizable groups with a pKa of less than 11 and salts of ionizable substituents having a pKa of less than 11. The pKa of the ionizable substituent refers to the pKa of the ionizable substituent as a whole, not just the acidic substituent. More preferably, the pKa is less than 10 and most preferably less than 9.

As previously mentioned above, the aromatic group may be further substituted or unsubstituted, for example, with alkyl groups. The $C_1$–$C_{20}$ alkyl group may be branched or unbranched. More preferably, the aromatic group is a phenyl or a naphthyl group and the ionizable substituents is a sulfonic acid group, a sulfinic acid group, a phosphonic acid group, or a carboxylic acid group. Representative examples of ionizable substituents include —COOH, —$SO_3H$, —$PO_3H_2$, —$SO_2NH_2$, and —$SO_2NHCOR$. Further, species, such as —COONa, —COOK, —$COO^-NR_4^+$, —$SO_3Na$, —$HPO_3Na$, —$SO_3^-NR_4^+$, and $PO_3Na_2$, where R is an alkyl or phenyl group, may also be used as a source of anionic organic ionic groups. Particularly preferred species are —COOH and —$SO_3H$ and their sodium and potassium salts. Most preferably, the organic ionic group is generated from a substituted or unsubstituted sulfophenyl group or a salt thereof, a substituted or unsubstituted (polysulfo)phenyl group or a salt thereof; a substituted or unsubstituted sulfonaphthyl group or a salt thereof; or a substituted or unsubstituted (polysulfo)naphthyl group or a salt thereof.

Specific organic ionic groups are —$C_6H_4CO_2^-$, —$C_6H_4SO_3^-$, —$C_{10}H_6CO_2^-$, —$C_{10}H_6SO_3^-$, and —$C_2H_4SO_3^{31}$.

Positively charged organic ionic groups may be generated from protonated amines which are attached to the pigment. For example, amines may be protonated to form ammonium groups in acidic media. Preferably, an organic group having an amine substituent has a pKb of less than 5. Positively charged organic ionic group may be also be quaternary ammonium groups (—$NR_3^+$) and quaternary phosphonium groups (—$PR_3^+$). Preferably, as described above, the organic ionic group contains an aromatic group such as a phenyl or a naphthyl group and a quaternary ammonium or a quaternary phosphonium group. The aromatic group is preferably directly attached to the pigment. Quaternized cyclic ammonium ions, and quaternized aromatic ammonium ions, can also be used as the organic ionic group. Thus, N-substituted pyridinium species, such as N-methyl-pyridyl, can be used in this regard. Examples of cationic organic ionic groups include, but are not limited to, -3-$C_5H_4NH^+$, -3-$C_5H_4N(C_2H_5)^+$, —$C_6H_4NC_5H_5^+$, —$C_6H_4COCH_2N(CH_3)_3^+$, —$C_6H_4COCH_2(NC_5H_5)^+$, -3-$C_5H_4N(CH_3)^+$, —$C_6H_4SO_2NH(C_4H_3N_2H^+)$, —$C_6H_4CH_2N(CH_3)_3^+$, —$C_6H_4NH_3^+$, —$C_6H_4N(CH_3)H_2^+$, —$ArNH(CH_3)_2^+$, —$ArCH_2NH_3^+$, —$ArCH_2NH(CH_3)_2^+$, —$ArCH_2NH_2(CH_3)^+$, —$ArCH_2CH_2NH_3^+$, —$ArCH_2CH_2NH_2(CH_3)^+$, and —$ArCH_2CH_2NH(CH_3)_2^+$ in which Ar represents an aromatic group. The aromatic group includes, but is not limited to, unsaturated cyclic hydrocarbons containing one or more rings. The aromatic group may be substituted or unsubstituted. Aromatic groups include aryl groups (for example, phenyl, naphthyl, anthracenyl, and the like), and heteroaryl groups (imidazolyl, pyrazolyl, pyndinyl, thienyl, thiazolyl, furyl, triazinyl, indolyl, and the like).

The amphiphilic counterion of the present invention is a molecule having a hydrophilic polar "head" and a hydrophobic organic "tail." The amphiphilic counterion may be cationic or anionic in nature. Representative examples of cationic and anionic amphiphilic counterions include those set forth and described in U.S. Pat. No. 5,698,016 to Adams et al., the entire description of which is incorporated herein by reference. For purposes of the present invention, the modified pigment particles, as indicated above, have a positive or negative charge. The charge preferably is created by the organic ionic group attached to the pigment. As explained earlier, if the modified pigment product is anionic, then the amphiphilic counterion will be cationic or positive charging. Similarly, if the modified pigment product is cationic, then the amphiphilic counterion will be anionic or negative charging.

Examples of cationic amphiphilic ions include, but are not limited to, those described ammonium ions that may be formed from adding acids to the following: a fatty amine, an ester of an aminoalcohol, an alkylamine, a polymer containing an amine functionality, a polyethoxylated amine, a polypropoxylated amine, a polyethoxylatedpolypropoxylatedamine, an aniline and derivatives thereof, a fatty alcohol ester of amino acid, a polyamine N-alkylated with a dialkyl succinate ester, a heterocyclic amine, a guanidine derived from a fatty amine, a guanidine derived from an alkylamine, a guanidine derived from an arylamine, an amidine derived from a fatty amine, an amidine derived from a fatty acid, an amidine derived from an alkylamine, or an amidine derived from an arylamine. The pKa of the ammonium ion is preferably greater than the pKa of the protonated form of the organic ionic group on the carbon.

Specific examples of cationic amphiphilic ions include dioctylamnmonium, oleylammonium, stearylammonium, dodecylammonium, dimethyldodecylammnonium, stearylguanidinium, oleylguanidinium, soyalkylammoniumn, cocoalkylammonium, oleylammoniumethoxylate, protonated diethanolaminedimyristate, and N-oleyldimethylammonium. Preferred cationic amphiphilic ions include, ditallowalkylammonium, dimethyloleylammonium, cocoalkyldimethylammonium, and dimethylhydrogenatedtalloalkylammonium. More preferred cationic amphiphilic ions include dicocoalkylammonium and dicyclohexylammonium. Generally, to form the ammonium ions described above, the various compounds described above such as fatty amines, esters of amino alcohols, etc., are reacted with an acid such as carboxylic acid, a mineral acid, an alkyl sulfonic acid, or an aryl sulfonic acid.

Quaternary ammonium salts can also be used as the sources of the cationic amphiphilic ion. Examples include, but are not limited to, a fatty alkyl trimethyl ammonium, a di(fatty alkyl)dimethylammonium, an alkyl trimethyl ammonium, or 1-alkyl pyridinium salt, where the counterion is a halide, methosulfate, sulfonate, a sulfate or the like. Also, phosphonium salts, such as tetraphenylphosphonium chloride can be used as the sources of the amphiphilic ion.

Cationic amphiphilic ions for use in the present invention include those represented by the formula $R_4N^+$, wherein R is independently hydrogen, $C_1$–$C_{30}$ alkyl, $C_1$–$C_{30}$ alkenyl, $C_7$–$C_{30}$ aralkyl, and $C_7$–$C_{30}$ alkaryl. The toner composition or developer composition can have cationic amphiphilic counterions having greater than 16 carbon atoms or greater than 24 carbon atoms. Preferably, the cationic amphiphilic ions have on average at least 16 carbons such as with cocoalkyltrimethylammonium, tallowalkyltrimethylammonium, hydrogenatedtallowalkyltrimethylammonium, soyalkyltrimethylammonium, benzylcocoalkyldimethylammonium and hexadecyltrimethylammonium. Most preferably, the cationic anphiphilic ions have at least 24 carbons such as with dicocoalkyldimethylammonium, dimethyldioctadecylammonium, dimethyl(2-ethylhexyl) hydrogenatedtallowalkylammonium, and dimethylditallowammonium.

Another example of a suitable amphiphilic ion is a polymer containing an ammonium ion derived from an amine containing polymer. The amine containing polymer can be a copolymer of an amine containing monomer, such as dimethylaminoethyl methacrylate or -acrylate, or vinylpyridine or vinylimidazole, and another monomer such as methyl acrylate, methyl methacrylate, butyl acrylate, styrene, and the like. The polymer may also be a ter- or tetra-polymer containing a mixture of an amine containing monomer and two or three other amine containing monomers, respectively. Such a polymer may be prepared by any means, such as radical (emulsion, suspension, or solution) or anionic polymerization.

As stated earlier, the amphiphilic ion can alternatively be an anionic amphiphilic ion. Examples of such anionic amphiphilic ions include, but are not limited to, an alkylbenzene sulfonate, an alkyl sulfonate, an alkylsulfate, a sulfosuccinate, a sarcosine, an alcohol ethoxylate sulfate, an alcohol ethoxylate sulfonate, an alkyl phosphate, an alkylethoxylated phosphate, an ethoxylated alkylphenol sulfate, a fatty carboxylate, a taurate, an isethionate, an aliphatic carboxylate, or an ion derived from a polymer containing an acid group. Sources of specific and preferred examples of anionic amphiphilic ions include, but are not limited to, sodium dodecylbenzene sulfonate, a sodium dodecylsulfate, AEROSOL OT, surfactant an oleic acid salt, a ricinoleic acid salt, a myrisitic acid salt, a caproic acid salt, sodium 2-octyldodecanoate, sodium bis(2-ethylhexyl) sulfosuccinate, a sulfonated polystyrene, or homo- or copolymers of acrylic acid or methacrylic acid or salts thereof.

Generally, the above-identified amphiphilic ions and related compounds are commercially available in salt form or can be routinely made by one of ordinary skill in the art.

The following discussion is with reference to the preparation or manufacture of the preferred modified pigment particle, carbon black. However, modified pigment particles other than carbon black can be similarly prepared. The modified carbon black may be prepared preferably by reacting carbon with a diazonium salt in a liquid reaction medium to attach at least one organic ionic group to the surface of the carbon. The diazonium salt may contain the organic ionic group to be attached to the carbon. A diazonium salt is an organic compound having one or more diazonium groups. Preferred reaction media include water, any medium containing water, and any medium containing alcohol. Water is the most preferred medium. Examples of modified carbon black and various preferred methods for their preparation are described in International Publication No. WO96/18688, published Jun. 20, 1996 and entitled "Reaction of Carbon Black with Diazonium Salts, Resultant Carbon Black Products and Their Uses," U.S. Pat. No. 5,554,739 entitled "Reaction of Carbon Materials With Diazonium Salts and Resultant Carbon Products," International Publication No. WO 96/18696, published Jun. 20, 1996 and entitled "Aqueous Inks and Coatings Containing Modified Carbon Products", and International Publication No. WO97/47699, published Dec. 18, 1997, and entitled "Modified Colored Pigments and Ink Jet Inks Containing Them", all incorporated herein by reference.

In the preferred preparation of the above modified carbon black, the diazonium salt need only be sufficiently stable to allow reaction with the carbon. Thus, that reaction can be carried out with some diazonium salts otherwise considered to be unstable and subject to decomposition. Some decomposition processes may compete with the reaction between the carbon and the diazonium salt and may reduce the total number of organic groups attached to the carbon. Further, the reaction may be carried out at elevated temperatures where many diazonium salts may be susceptible to decomposition. Elevated temperatures may also advantageously increase the solubility of the diazonium salt in the reaction medium and improve its handling during the process. However, elevated temperatures may result in some loss of the diazonium salt due to other decomposition processes. The diazonium salts may be prepared in situ. It is preferred that the modified carbon black of the present invention contain no by-products or unattached salts.

The chargeable modified pigment particle may be prepared by the reaction of the modified pigment particle having an organic ionic group, with the salt of an amphiphile. For instance, an aqueous dispersion of an anionically modified carbon black can be combined with an amine containing compound and one or more equivalents of an acid; or can be combined with a quaternary ammonium salt; or can be combined with an amine containing polymer and one or more equivalents of an acid. Alternatively, a cationically modified carbon black can be combined with an anionic amphiphile. The resulting products, whether anionic or cationic in nature, may be purified by washing, such as by filtration, to remove unreacted raw materials, byproduct salts and other reaction impurities. The products can also be isolated, for example, by evaporation or it may be recovered by filtration and drying using known techniques to those skilled in the art.

Alternatively, an aqueous dispersion of the modified carbon black or pigment particle, as its free acid, may be combined with an amine containing amphiphile. In this way the modified carbon product protonates the amine, thus forming ions from each of the two components. The complimentary case may be useful for a modified carbon black bearing a free base with an acidic amphiphilic compound.

In addition, the modified carbon black or pigment particle having attached ionic groups may further be prepared using known techniques to those skill in the art, such as by adding the modified carbon black or pigment particle to a continuously operating pin mixer with an amphiphilic ion of the opposite charge in an aqueous solution. Alternatively, the carbon black or pigment particle, the reagents for attaching the organic ionic group to the carbon black or pigment particle, and an amphiphilic ion source may be added simultaneously in a suitable batch or continuous mixer. The resultant material is optionally purified and subsequently dried for use in toner and developer applications.

The amount of the amphiphilic ion that is present in the composition of the chargeable modified pigment particle is generally introduced in an amount should be sufficient to neutralize at least a portion of the charged groups on the pigment surface, for example a carbon black or similar product. It is preferred to neutralize about 75% or more of the charged groups on the pigment surface. Flocculation may or may not occur during neutralization.

The resin particles for the toner composition or the developer composition can comprise styrenic polymer-based or polyester-based resin particles. The styrenic polymer-based resin particles can be styrenated acrylic resin particles. Illustrative examples of suitable toner resins selected for the toner and developer compositions of the present invention include, polyamides, polyolefins, polycarbonates, styrene acrylates, styrene methacrylates, styrene butadienes, crosslinked styrene polymers, epoxies, polyurethanes, vinyl resins, including homopolymers or copolymers of two or more vinyl monomers, polyesters and mixtures thereof. In particular, the resin particles may include homopolymers of styrene and its derivatives and copolymers thereof such as polystyrene, poly-p-chlorostyrene, polyvinyltoluene, styrene-p-chlorostyrene copolymer, styrene-vinyltoluene copolymer, copolymers of styrene and acrylic acid ester such as styrenemethyl acrylate copolymer, styrene-ethyl acrylate copolymer, styrene-n-butyl acrylate copolymer, styrene-2-ethylhexyl acrylate copolymer; copolymers of styrene and methacrylic acid ester such as styrene-methyl methacrylate, styrene-ethyl methacrylate, styrene-n-butyl methacrylate, styrene-2-ethylhexyl methacrylate; multi-component copolymers of styrene, acrylic acid ester and methacrylic acid ester; styrene copolymers of styrene with other vinyl monomers such as styrene-acrylonitrile copolymer, styrene-vinyl methyl ether copolymer, styrene-butadiene copolymer, styrene-vinyl methyl ketone copolymer, styrene-acrylonitrile-indene copolymer, styrene-maleic acid ester copolymer, polymethyl methacrylate, polybutyl methacrylate, polyvinyl acetate, polyvinyl butyral, polyacrylic acid resin, phenolic resin, aliphatic or alicyclic hydrocarbon resin, petroleum resin, chlorin paraffin, either individually or as a mixtures. Useful polyesters are copolyesters prepared from terephthalic acid (including substituted terephthalic acid), a bis [(hydroxyalkoxy)phenyl]alkane having from 1 to 4 carbon atoms in the alkoxy radical and from 1 to 10 carbon atoms in the alkane moiety (which can also be halogen-substituted alkane), and alkylene glycol having from 1 to 4 carbon atoms in the alkylene moiety.

Other types of suitable resins for toner compositions of the present invention will be known to those skilled in the art.

The resin particles are generally present in an effective amount, typically between 60 to about 95 weight percent. These binder resins may be used singly or in combination. Generally, resins particularly suitable for use in xerographic toner manufacturing have a melting point (ring and ball method) in the range of 100° C. to 135° C. and have a glass transition temperature (Tg) greater than about 60° C. Examples of styrenic polymer-based resin particles and suitable amounts can also be found in U.S. Pat. Nos. 5,278,018; 5,510,221; 5,275,900; 5,571,654; 5,484,575; and EP 0 270 066 A1, all incorporated in their entirety by reference herein.

Alternatively, polyester based toner particles can be used. Example of such toner particles and suitable amounts can be found in U.S. Pat. Nos. 4,980,448; 5,529,873; 5,652,075; and 5,750,303, all incorporated in their entirety by reference herein.

As shown in the examples, various loading levels of the pigment and treatment levels can be used. Certain modified pigments are preferably used at lower levels, while other modified pigments are preferably used at higher levels in the toner compositions.

Generally, the chargeable modified pigment particles, alone or with carbon black, magnetite, or other pigments, is present in total amounts of from about 1% by weight to about 30% by weight of the toner or developer composition. The amount of pigment present in the toner composition is preferably from about 0.1 to about 12 wt parts per 100 wt parts of resin. However, lesser or greater amounts of the chargeable modified pigment particles may be used. Also, generally, the toner resin is present in amounts of from about 60% by weight to about 99% by weight of the toner or developer composition.

As described earlier, one or more organic ionic groups can be attached to the pigment. Also, the chargeable modified pigment particles may be used with untreated pigment(s), such as conventional carbon black, in the toner composition. Further, two or more chargeable modified pigment particles, each having a different organic ionic group attached to the pigment, can be used. In addition, any combination of the above can be used in the toner compositions of the present invention.

Optional external additives may also be mixed or blended with the toner compositions of the present invention including carrier additives; additional positive or negative charge control agents such as quaternary ammonium salts, pyridinium salts, sulfates, phosphates, and carboxylates; flow aid additives; silicone oils; waxes such as commercially available polypropylenes and polyethylenes; magnetite; and other known additives. The toner composition can be a magnetic toner further comprising iron oxide, wherein the iron oxide can be magnetite. Generally, these additives are present in amounts of from about 0.05 by weight to about 30% by weight, however, lesser or greater amounts of the additives may be selected depending on the particular system and desired properties. Specific examples of additives and amounts are also described in the patents and the European patent application mentioned above and incorporated herein by reference. An advantage of the use of the chargeable modified pigment particles in toner and developer compositions of the present invention is that the amount of the charge control agent may be reduced or eliminated.

The toner compositions can be prepared by a number of known methods, such as admixing and heating the resin, the chargeable modified pigment particles, optional charge enhancing additives and other additives in conventional melt extrusion devices and related equipment. Other methods include spray drying and the like. Compounding of the modified pigment and other ingredients with the resin is generally followed by mechanical attrition and classification to provide toner particles having a desired particle size and particle size distribution. Conventional equipment for dry blending of powders may be used for mixing or blending the modified pigment particles with the resin. Again, conventional methods of preparing toner and developer compositions can be used and are described in the patents and European application described above and incorporated herein by reference.

In more detail, the toner material can be prepared by dry blending the binder resin with all other ingredients, including the chargeable modified pigment particles and any other pigments, and then melt-extruding in a high shear mixer to form a homogeneously mixed mass. During this process the components are held at a temperature above the melting point of the binder resin, and those components that are insoluble in the resin are ground so that their average particle size is reduced. This homogeneously mixed mass is then allowed to cool and solidify, after which it is pre-ground to an average particle size of about 100 microns. This material is then further subjected to particle size reduction until its average particle size meets the size range specification required for classification. A variety of classifying techniques may be used The preferred type is an air classification type. By this method, particles in the ground material which are too large or too small are segregated from the portion of the material which is of the desired particle size range.

The toner composition of the present invention may be used alone in monocomponent developers or may be mixed with suitable carrier particles to form dual component developers. The carrier vehicles which can be used to form dual component developer compositions can be selected from various materials. Such materials typically include carrier core particles and core particles overcoated with a thin layer of film-forming resin to help establish the correct triboelectric relationship and charge level with the toner employed. Suitable carriers for two component toner compositions include iron powder, glass beads, crystals of inorganic salts, ferrite powder, nickel powder, steel, or mixtures thereof, all of which are typically coated with resin coating such as an epoxy or fluorocarbon resin. Examples of carrier particles and coatings that can be used and are described in the patents and European application described above and incorporated herein by reference.

The present invention is further directed to a method of imaging which includes formulating an electrostatic latent image on a negatively charged photoconductive imaging member, affecting the development thereof with toner composition comprising resin particles and chargeable modified pigment particles, and thereafter transferring the developed image onto a suitable substrate. The transferred image can be permanently fixed to the substrate. Conventional methods of imaging can be used, such as shown in the patents and European patent application described above.

The present invention will be further clarified by the following examples which are intended to be purely exemplary of the present invention.

EXAMPLE 1

Preparation of Carbon Black Products

An eight inch pelletizer was charged with p-aminobenzoic acid (PABA) and 600 g of carbon black. The carbon black, REGAL® 330 carbon black, had a surface area of 94 $m^2/g$ and a DBPA of 65 mL/100 g. The pelletizer was run at 400 rpm for one minute. Water (200 g), a solution of $NaNO_2$ in 150 g of water and finally 100 g of water were added in succession over 1.5, 2, and 2 min, respectively, while the pelletizer was running at 600 rpm. The product was dried overnight at 70° C. and had attached p-$C_6H_4COO^-Na^+$ groups.

| Example | PABA, g | NaNO2, g | Treatment level, mmol/g |
|---|---|---|---|
| 1A | 8.3 | 4.2 | 0.1 |
| 1B | 16.7 | 8.4 | 0.2 |
| 1C | 25.0 | 12.5 | 0.3 |

EXAMPLE 2

Preparation of a Carbon Black Product

An eight inch pelletizer was charged with 22.2 g of p-aminobenzoic acid and 800 g of carbon black. The carbon black, REGAL® 330 carbon black, had a surface area of 94 $m^2/g$ and a DBPA of 65 mL/100 g. The pelletizer was run at 400 rpm for one minute. Water (0–250 g), a solution of 11.2 g of $NaNO_2$ in 150 g of water and finally 50–250 g of water were added in succession over 1, 2–3, and 2–3 min, respectively, while the pelletizer was running at 700 rpm. The total amount of water used was about 450 g. The product was dried overnight at 70° C. and had attached $p\text{-}C_6H_4COO^-Na^+$ groups. Several runs were made under these conditions and the products were combined.

EXAMPLE 3

Preparation of a Carbon Black Product

An eight inch pelletizer was charged with 35.3 g of p-aminobenzoic acid and 800 g of carbon black. The carbon black, REGAL® 330 carbon black, had a surface area of 94 $m^2g$ and a DBPA of 65 mL/100 g. The pelletizer was run at 400 rpm for one minute. Water (250–300 g), a solution of 16.7 g of $NaNO_2$ in 150 g of water and finally 70–150 g of water were added in succession over 1, 3, and 2 min, respectively, while the pelletizer was running at 600 rpm. The total amount of water used was about 550 g. The product was dried overnight at 70° C. and had attached $p\text{-}C_6H_4COO^-Na^+$ groups. Several runs were made under these conditions and the products were combined.

EXAMPLE 4

Preparation of a Carbon Black Product

An eight inch pelletizer was charged with 28.4 g of sulfanilic acid and 800 g of carbon black. The carbon black, REGAL® 330 carbon black, had a surface area of 94 $m^2/g$ and a DBPA of 65 mL/100 g. The pelletizer was run at 400 rpm for one minute. Water (200 g), a solution of 11.2 g of $NaNO_2$ in 150 g of water and finally 100 g of water were added in succession over 1.5, 2, and 1 min, respectively, while the pelletizer was running at 600 rpm. The product had attached $p\text{-}C_6H_4SO_3^-Na^+$ groups and contained water.

EXAMPLE 5

Preparation of Carbon Black Products

An eight inch pelletizer was charged with 28.0 g of sulfanilic acid and 800 g of carbon black. The carbon black, REGAL® 330 carbon black, had a surface area of 94 $m^2/g$ and a DBPA of 65 mL/100 g. The pelletizer was run at 400 rpm for one minute. Water (250 g), a solution of 11.2 g of $NaNO_2$ in 250 g of water and then 50 g of water were added in succession over 1, 3.5, and 1 min, respectively, while the pelletizer was running at 600 rpm. The product had attached $p\text{-}C_6H_4SO_3^-Na^+$ groups and contained water.

EXAMPLE 6

Preparation of Amphiphilic Salts of Carbon Black Products

A solution of a quaternary ammonium compound was diluted with 500 g of water and added to a stirring suspension of 350 g of a carbon black product from Examples 1, 3 or 4 in 3 L of water. After stirring for 30 min, the mixture was allowed to settle, and the supernatant was decanted. In some cases, the residual material was washed by stirring it with 3 L of water, allowing it to settle and decanting it. The washing substantially removed the byproduct salts. The product was dried at 50–70° C.

| Example | Amphiphile‡ | Amphiphile amount (g) | Amphiphile amount mmol/g | Carbon Black Product Used | # of washes | Attached group |
|---|---|---|---|---|---|---|
| 6A | ARQUAD ® 2C-75[1] | 17.5 | 0.08 | Example 1A | 1 | $C_6H_4COO^-$ $Me_2Coco_2N^+$ |
| 6B | ARQUAD ® 2C-75[1] | 34.9 | 0.16 | Example 1B | 1 | $C_6H_4COO^-$ $Me_2Coco_2N^+$ |
| 6C | ARQUAD ® 2C-75[1] | 34.9 | 0.16 | Example 1B | 0 | $C_6H_4COO^-$ $Me_2Coco_2N^+$ |
| 6D | ARQUAD ® 2C-75[1] | 52.3 | 0.25 | Example 1C | 2 | $C_6H_4COO^-$ $Me_2Coco_2N^+$ |
| 6E | ARQUAD ® 2C-75[1] | 34.9 | 0.16 | Example 4 | 2# | $C_6H_4SO_3^-$ $Me_2Coco_2N^+$ |
| 6F | ARQUAD ® 2C-75[1] | 34.9 | 0.16 | Example 4 | 0# | $C_6H_4SO_3^-$ $Me_2Coco_2N^+$ |
| 6G | ARQUAD ® HTL8MS85[2] | 24.8 | 0.11 | Example 1B | 1 | $C_6H_4COO^-$ $Me_2C_8H_{17}$ (HyTallow)$N^+$ |
| 6H | ARQUAD ® 2HT-75[3] | 31.5 | 0.12 | Example 1B | 2* | $C_6H_4COO^-$ $Me_2(HyTallow)_2N^+$ |
| 6I | ARQUAD ® 2HT-75[3] | 19.2 | 0.07 | Example 1B | 1** | $C_6H_4COO^-$ $Me_2(HyTallow)_2N^+$ |
| 6J | ARQUAD ® C-33W[4] | 49.0 | 0.16 | Example 1B | 1 | $C_6H_4COO^-$ $Me_3CocoN^+$ |
| 6K | ARQUAD ® T-27W[5] | 31.5 | 0.07 | Example 1B | 2 | $C_6H_4COO^-$ $Me_3$(Tallow)$N^+$ |
| 6L | ARQUAD ® T-27W[5] | 19.2 | 0.04 | Example 1B | 1 | $C_6H_4COO^-$ $Me_3$(Tallow)$N^+$ |
| 6M | ETHOQUAD ® C/25[6] | 54.5 | 0.16 | Example 2 | 2 | $C_6H_4COO^-$ MeCoco (ethoxylate-7.5)$_2N^+$ |
| 6N | ARQUAD ® 2HT-75[3] | 64.4 | 0.24 | Example 3 | 2** | $C_6H_4COO^-$ $Me_2(HyTallow)_2N^+$ |

-continued

| Example | Amphiphile‡ | Amphiphile amount (g) | Amphiphile amount mmol/g | Carbon Black Product Used | # of washes | Attached group |
|---|---|---|---|---|---|---|

[1]Dimethyldicocoammonium chloride, 74–77%
[2]Dimethylethylhexylhydrogenatedtallowammonium methosulfate, 81.5–84.5%
[3]Dimethyldihydrogenatedtallowammonium chloride, 74–77%;
[4]Cocotrimethylammonium chloride, 32–35%
[5]Tallowtrimethylammonium chloride, 26–29%
[6]Methylcocoammoniumethoxylate-15
#Product collected by filtration
*Wash also contained 0.7 L EtOH
**Quaternary amine solution and wash solutions also contained 0.4 L EtOH
‡ARQUAD and ETHOQUAD are trademarks of Akzo Nobel Chemicals Inc. (Chicago, IL)

EXAMPLE 7

Preparation of Carbon Black Products

A solution of an amine hydrochloride was prepared from 56 mmol of the corresponding amine, 5.6 g f concentrated HCl and 500 g of water. The amine hydrochloride solution was added to a stirring suspension of 350 g of a carbon black product (solids basis) from samples 1,3 or 5 in about 3 L of water. In some cases, additional solvent was added. After stirring for 30 min, the mixture was filtered, or it was allowed to settle, and the supernant was decanted. The residual material was washed twice with the same water/solvent solution used for the reaction of the amine hydrochloride with the car black product. The washing substantially removed the byproduct salts. The product was dried at 50–70° C.

| Ex. | Amine | Amine wt, g | Carbon black product used | Add'l solvent | Attached groups |
|---|---|---|---|---|---|
| 7A | JEFFAMINE XTJ-505[1] | 33.7 | Example 1B | — | $C_6H_4COO^-$ $H_3N^+(C_2H_4O)_x(C_3H_6O)_yH$ |
| 7B | JEFFAMINE XTJ-506[2] | 56.0 | Example 1B | — | $C_6H_4COO^-$ $H_3N^+(C_2H_4O)_x(C_3H_6O)_yH$ |
| 7C | Dioctylamine | 13.6 | Example 1B | EtOH, 425 g | |
| 7D | ETHOMEEN O/15[3] | 27.1 | Example 1B | — | $C_6H_4COO^-$ $HN^+Oleyl((C_2H_4O)_xH)_2$ |
| 7E | Dimethyloleylamine | 16.5 | Example 1B | — | $C_6H_4COO^-$ $HMe_2N^+C_{18}H_{35}$ |
| 7F | Dimethylhydrogenated tallow amine | 16.4 | Example 2 | — | $C_6H_4COO^-$ $HMe_2N^+HyTallow$ |
| 7G | Oleyl amine | 15.5 | Example 5 | EtOH, 100 g | $C_6H_4COO^-$ $HMe_2N^+C_{18}H_{35}$ |
| 7H | Methyldicocoamine | 33.2 | Example 3 | EtOH, 325 g | $C_6H_4COO^-$ $HMeN^+Coco_2$ |

[1]Aminated 9/1 poly(propyleneoxide/ethyleneoxide) MW 600
[2]Aminated 3/19 poly(propyleneoxide/ethyleneoxide) MW 1000
[3]Oleylamineethoxylate(5)

EXAMPLE 8

Preparation of Carbon Black Products

A solution of dicocoamine hydrochloride was prepared from dicocoamine, concentrated HCl, 500 g of water and 1.6 L of THF. The amine hydrochloride solution was added to a stirring suspension of 350 g of a carbon black product from Example 1 or Example 4 in 3 L of water. After stirring for 30 min, the mixture was filtered, or it was allowed to settle, and the supernatant was decanted. The residual material was washed twice with a solution of 1.6 L of THF in 3 L of water. The washing substantially removed the byproduct salts. The product was dried at 50–70° C.

| Example | Amine amount g | Amine amount, mmol/g black | Concentrated HCl, g | Carbon black product |
|---|---|---|---|---|
| 8A | 22.5 | 0.16 | 5.5 | Example 1B |
| 8B | 33.7 | 0.24 | 8.3 | Example 1C |
| 8C | 22.5 | 0.16 | 5.5 | Example 4 |

EXAMPLE 9

Preparation of a Carbon Black Product

An eight inch pelletizer was charged with 22.2 g of p-aminobenzoic acid and 800 g of carbon black. The carbon black, REGAL® 330 carbon black, had a surface area of 94 $m^2/g$ and a DBPA of 65 mL/100 g. The pelletizer was run at 400 rpm for one minute. Water (200 g), a solution of 11.1 g of $NaNO_2$ in 150 g of water, 100 g of water, and finally a solution of 38.8 g of oleylammonium chloride in 100 g of water were added in succession over 1, 2, 1 and 2.5 min, respectively, while the pelletizer was running at 600 rpm. The product was dried at 70° C. and had attached $p\text{-}C_6H_4COO^-C_{18}H_{35}NH_3^+$ groups.

EXAMPLE 10

Preparation of a Carbon Black Product

Carbon black (800 g) and 22.2 g of p-aminobenzoic acid were mixed in an eight inch pelletizer at 400 rpm for one minute. The carbon black, REGAL® 330 carbon black, had a surface area of 94 $m^2/g$ and a DBPA of 65 mL/100 g. Dicyclohexylammonium nitrite (37.7 g) was then added and mixing was continued at 400 rpm for 0.5 min. Water (420 g) was added over 6 min while the pelletizer was run at 600 rpm. The product was dried at 70° C., and had attached $C_6H_4COO^-H_2N(C_6H_{11})_2^+$ groups.

EXAMPLE 11

Preparation of a Carbon Black Product

A suspension of 16.0 g of dicyclohexylammonium nitrite in about 200 g of water was added to a heated (70° C.), stirring suspension of 3 L of water, 12.1 g of sulfanilic acid and 350 g of a carbon black having a surface area of 94 $m^2/g$ and a DBPA of 65 mL/100 g. After stirring for an hour, the mixture was allowed to stand overnight and was filtered. The product was washed with ethanol and then water. The product was dried at 70° C. and had attached $C_6H_4SO_3^-H_2N(C_6H_{11})_2^+$ groups.

EXAMPLE 12

Preparation of a Carbon Black Product

A suspension of 24.7 g of dicyclohexylammonium nitrite in about 250 g of water was added to a heated (70° C.), stirring suspension of 3 L of water, 11.3 g of p-aminobenzoic acid and 350 g of a carbon black having a surface area of 94 $m^2/g$ and a DBPA of 65 mL/100 g. After stirring for an hour, the mixture was allowed to stand overnight and the supernatant liquid was decanted. The product was washed with ethanol and then with water. The product was dried at 70° C. and had attached $C_6H_4COO^-H_2N(C_6H_{11})_2^+$ groups.

EXAMPLE 13

Preparation of a Carbon Black Product

A solution of 21.4 g of ARQUAD® 2C-75 Dimethyldicocoammonium chloride in about 1 L of water was added to a stirring suspension of 150 g of the carbon black product of Example 2B. After stirring for about 30 minutes, the mixture was allowed to stand and the supernatant liquid was decanted. The product was washed with water one more time. The product was dried at 70° C. and had attached $C_6H_4COO^-Me_2Coco_2N^+$ groups.

EXAMPLE 14

Preparation of Carbon Black Products

A 130 L plow mixer was charged with 41 Kg of water, 0.95 Kg of sulfanilic acid and 25 Kg of a carbon black with a surface area of 94 $m^2/g$ and a DBPA of 65 mL/100 g. After mixing for 30 min at 60° C., a solution of 0.38 Kg of $NaNO_2$ in 7 Kg of water was added over 15 min, and the mixing was continued for an additional 30 min. Water (21 Kg) and then a solution of an amphiphile was added and mixing was continued for 15 minutes. In Example 14C, the product was washed twice. The washing was done by adding 68 Kg of water, allowing the product to settle and decanting the superantant liquid. All of the products were dried in an oven at 70° C.

| Example | Amphiphile | Amphiphile, Kg | Attached group |
|---|---|---|---|
| 14A | ARQUAD® 2C-75[1] | 2.38 | $C_6H_4SO_3^-Me_2Coco_2N^+$ |
| 14B | ARQUAD® HTL8MS85[2] | 2.52 | $C_6H_4SO_3$ $Me_2C_8H_{17}(HyTallow)N^+$ |
| 14C | ARQUAD® HTL8MS85[2] | 2.52 | $C_6H_4SO_3^-$ $Me_2C_8H_{17}(HyTallow)N^+$ |

[1]Dimethyldicocoammonium chloride, 74–77%
[2]Dimethylethylhexylhydrogenatedtallowammonium methosulfate, 81.5–84.5%

EXAMPLE 15

Preparation of a Carbon Black Product

A 130 L plow mixer was charged with 41 Kg of water, 0.69 Kg of 4-aminobenzoic acid and 25 Kg of a carbon black with a surface area of 94 $m^2/g$ and a DBPA of 65 mL/100 g. After mixing for 30 min at 60° C., a solution of 0.35 Kg of $NaNO_2$ in 7 Kg of water was added over 15 min, and the mixing was continued for an additional 60 min. Water (21 Kg) and then 1.73 Kg of ARQUAD® HTL8MS85 Dimethylethylhexylhydrogenatedtallowammonium methosulfate were added and mixing was continued for 15 minutes. The product was dried at 70° C. and had attached $C_6H_4COO^-Me_2C_8H_{17}$(Hydrogenatedtallowalkyl)$N^+$ groups.

EXAMPLE 16

Preparation and Evaluation of Toners

Black toners were prepared by the conventional technique of melt-mixing, extruding, pregrinding, jetmilling and classifying. Thus, 8 parts of carbon black and 92 parts of DIALEC 1601 styrenated acrylic polymer (available from Polytribo Inc., Bristol, Pa. were melt extruded with a Werner and Pfleiderer ZSK-30 twin screw extruder. The resulting black/polymer product was granulated in a Kayness mini granulator, and then jetmilled and classified using a Hosokawa Alpine AFG Model 100 mill to form a black toner powder having an average particle size of about 8 microns, as determined using a Coulter Multisizer II. The toners were evaluated in this form or after blending the material with 0.5 wt % CAB-O-SIL® TG820F fumed silica (manufactured by Cabot Corporation) by rolling with steel shots having a diameter of ⅛" in a glass vessel on a two roll mill for 30 minutes.

Developer compositions were prepared by mixing the toner or toner/silica blend with a positive charging (Type 13) carrier available from Vertex in an amount sufficient to yield a 2.0 wt % loading. The samples were conditioned for at least three days at below 30% RH or in a dessicator at ambient temperature (Dry) or at 83% RH at 27° C. (Humid). Tribocharge measurements were made by tumble blending the developer compositions (toner or toner/silica mixture plus carrier) in glass vessels on a roll mill. After blending for 2 or 60 minutes, a small sample of the developer composition was removed and its charge to mass ratio (Q/M) was determined by the Faraday cage blow off method using a Vertex T-150 tribocharge tester. The results shown below indicate that the samples charged more positively than the control based on REGAL® 330 carbon black.

| Example | Carbon Product Example | Q/M Dry 2 Min μC/g | Q/M Dry 60 Min μC/g | Q/M Humid 60 Min μC/g | Q/M Dry Silica 60 Min μC/g | Q/M Humid Silica 60 Min μC/g |
|---|---|---|---|---|---|---|
| 16A | 6A | 20 | 20 | 20 | 3 | 4 |
| 16B | 6B | 27 | 31 | 27 | 15 | 12 |
| 16C | 6C | 23 | 27 | 27 | 3 | 12 |
| 16D | 6D | 25 | 31 | 27 | 13 | 12 |
| 16E | 6E | 27 | 37 | 38 | 14 | 16 |
| 16F | 6F | 22 | 31 | 31 | 8 | 11 |
| 16G | 6G | 19 | 27 | 25 | 7 | 8 |
| 16H | 6H | 24 | 33 | 30 | 9 | 11 |
| 16I | 6I | 16 | 23 | 19 | 3 | 4 |
| 16J | 6J | 15 | 16 | 15 | 3 | 3 |
| 16K | 6K | 15 | 14 | 15 | 5 | 3 |
| 16L | 6L | 12 | 11 | 13 | 1 | 2 |
| 16M | 7F | 18 | 20 | 20 | 2 | 3 |
| 16N | 8A | 17 | 29 | 16 | 0 | 2 |
| 16O | 8B | 25 | 45 | 40 | 10 | 10 |
| 16P | 8C | 14 | 26 | 21 | 0 | 3 |
| 16Q | 10 | 32 | 33 | 30 | 5 | 8 |

-continued

| Example | Carbon Product Example | Q/M Dry 2 Min μC/g | Q/M Dry 60 Min μC/g | Q/M Humid 60 Min μC/g | Q/M Dry Silica 60 Min μC/g | Q/M Humid Silica 60 Min μC/g |
|---|---|---|---|---|---|---|
| 16R | 11 | 11 | 19 | 17 | −1 | 2 |
| 16S | 12 | 22 | 23 | 20 | 0 | 2 |
| 16T | 14A | 23 | 31 | 34 | 11 | 17 |
| 16U | 14B | 27 | 34 | 36 | 13 | 17 |
| 16V | 14C | 21 | 28 | 27 | 2 | 10 |
| 16W | 15 | 21 | 22 | 23 | 1 | 7 |
| Control | Regal ® 330 | 8 | 1 | 9 | −4 | 0 |

EXAMPLE 17

Preparation and Evaluation of Toners

Toners were prepared according to Example 16, except that the evaluations were carried out under ambient conditions. The results show that the samples charged more positively than the control based on REGAL® 330 carbon black.

| Example | Carbon Product | Q/M 60 Min μC/g |
|---|---|---|
| 17A | Example 6M | 13 |
| 17B | Example 7A | 12 |
| 17C | Example 7B | 6 |
| 17D | Example 7C | 16 |
| 17E | Example 7D | 15 |
| 17F | Example 7E | 21 |
| 17G | Example 7G | 11 |
| 17H | Example 9 | 11 |
| Control | REGAL ® 330 | 4 |

EXAMPLE 18

Preparation and Evaluation of Toners

Toners were prepared and evaluated by the method of Example 16 except that FINETONE 382ES-HMW polyester resin from Reichhold Chemicals, Inc. (Durham, N.C.) was used in place of the styrene acrylate resin. The results show that the samples charged more positively than the control based on REGAL® 330 black.

| Example | Carbon Product | Q/M Dry 2 Min μC/g | Q/M Dry 60 Min μC/g | Q/M Humid 60 Min μC/g | Q/M Dry Silica 60 Min μC/g | Q/M Humid Silica 60 Min μC/g |
|---|---|---|---|---|---|---|
| 18A | Example 6N | 12 | 11 | 6 | 13 | 8 |
| 18B | Example 7H | 16 | 13 | 4 | 14 | 7 |
| Control | REGAL ® 330 | 1 | 1 | 1 | 9 | 1 |

EXAMPLE 19

Preparation and Evaluation of Toners

Monocomponent magnetic toners were prepared and evaluated by the method of Example 16 except that the toners were prepared from 2 parts carbon black, 40 parts BAYOXIDE 8600 iron oxide from Bayer, and 58 parts DIALEC 1601 styrenated acrylic polymer. The results show that the samples charged more positively than the control based on REGAL® 330 black.

| Example | Carbon Product | Q/M Dry 2 Min μC/g | Q/M Dry 60 Min μC/g | Q/M Humid 60 Min μC/g | Q/M Dry Silica 60 Min μC/g | Q/M Humid Silica 60 Min μC/g |
|---|---|---|---|---|---|---|
| 19 | Example 13 | 7 | 8 | 11 | 5 | 5 |
| Control | REGAL ® 330 | 2 | −1 | 3 | 0 | 2 |

The chargeable modified pigment particles as described herein are readily dispersible in toner and developer compositions, provide effective coloring and pigmenting capabilities and may further influence the charging characteristics of same. As a result, the use of the chargeable modified pigment particles may reduce or eliminate the need for separate charge control agents.

Other embodiments of the present invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A toner composition comprising the product of the mixture of: a) resin particles and b) at least one chargeable modified pigment particle comprising at least one organic ionic group attached to the pigment particle and at least one amphiphilic counterion, wherein said amphiphilic counterion has a charge opposite to that of said organic ionic group, wherein said organic ionic group comprises: at least one aromatic group or at least one $C_1$–$C_{20}$ alkyl group, or mixtures thereof, wherein at least one of the aromatic groups or at least one of the $C_1$–$C_{20}$ alkyl groups is directly attached to the pigment particle.

2. The toner composition of claim 1, wherein said pigment particle is carbon black, cyan pigment, magenta pigment, yellow pigment, blue pigment, green pigment, brown pigment, violet pigment, red pigment or mixtures thereof.

3. The toner composition of claim 1, wherein said pigment particle is carbon black.

4. The toner composition of claim 1, further comprising unmodified carbon black, cyan pigment, magenta pigment, yellow pigment, blue pigment, green pigment, brown pigment, violet pigment, red pigment or mixtures thereof.

5. The toner composition of claim 1, wherein said resin particles comprise styrenic polymer-based or polyester-based resin particles.

6. The toner composition of claim 5, wherein said styrenic polymer-based resin particles are styrenated acrylic resin particles.

7. The toner composition of claim 5, wherein said styrenic polymer-based resin particles are homopolymers and copolymers of styrene and its derivatives; copolymers of styrene and acrylic acid esters; copolymers of styrene and methacrylic acid esters; multi-component copolymers of styrene, acrylic acid ester and methacrylic acid esters; or copolymers of styrene and vinyl monomers.

8. The toner composition of claim 1, wherein said organic ionic group is a cationic group.

9. The toner composition of claim 8, wherein said cationic ionic group is selected from:

-3-$C_5H_4NH^+$, -3-$C_5H_4N(C_2H_5)^+$, —$C_6H_4NC_5H_5^+$, —$C_6H_4COCH_2N(CH_3)_3^+$, —$C_6H_4COCH_2(NC_5H_5)^+$, -3-$C_5H_4N(CH_3)^+$, —$C_6H_4SO_2NH(C_4H_3N_2H^+)$, —$C_6H_4CH_2N(CH_3)_3^+$, —$C_6H_4NH_3^+$, —$C_6H_4N(CH_3)H_2^+$, —$ArNH(CH_3)_2^+$, —$ArCH_2NH_3^+$, —$ArCH_2NH(CH_3)_2^+$, —$ArCH_2NH_2(CH_3)^+$, —$ArCH_2CH_2NH_3^+$, —$ArCH_2CH_2NH_2(CH_3)^+$, or —$ArCH_2CH_2NH(CH_3)_2^+$, wherein Ar represents an aromatic group.

10. The toner composition of claim 1, wherein said organic ionic group is an anionic group.

11. The toner composition of claim 10, wherein said anionic group is selected from the group consisting of: —$C_6H_4CO_2^+$, —$C_6H_4SO_3^-$, —$C_{10}H_6CO_2^-$, —$C_{10}H_6SO_3^-$, and —$C_2H_4SO_3^-$.

12. The toner composition of claim 11, wherein said anionic group is —$C_6H_4CO_2^-$.

13. The toner composition of claim 11, wherein said anionic group —$C_6H_4SO_3^-$.

14. The toner composition of claim 11, wherein said amphiphilic counterion is cationic amphiphilic counterion, said counterion being an ammonium ion formed from the addition of an acid to a compound selected from: a fatty amine, an ester of an aminoalcohol, an alkylamine, a polymer containing an amine functionality, a polyethoxylated amine, a polypropoxylated amine, a polyethoxylatedpolypropoxylatedamine, an aniline, a fatty alcohol ester of amino acid, a polyamine N-alkylated with a dialkyl succinate ester, a heterocyclic amine, a guanidine derived from a fatty amine, a guanidine derived from an alkylamine, a guanidine derived from an arylamine, an amidine derived from a fatty amine, an amidine derived from a fatty acid, an amidine derived from an alkylamine, or an amidine derived from an arylamine.

15. The toner composition of claim 11, wherein said amphiphilic counterion is a cationic amphiphilic counterion selected from: dioctylammonium, oleylammonium, stearylammonium, dodecylammonium, dimethyldodecylammonium, stearylguanidinium, oleylguanidinium, soyalkylammonium, cocoalkylammonium, oleylammoniumethoxylate, protonated diethanolaminedimyristate; or N-oleyldimethylammonium.

16. The toner composition of claim 11, wherein said amphiphilic counterion is a cationic amphiphilic counterion selected from: ditallowalkylammonium, dimethyloleylammonium, cocoaalkyldimethylammonium, or dimethylhydrogenatedtalloalkylammonium.

17. The toner composition of claim 11, wherein said amphiphilic counterion is cationic and is dicocoalkylammonium or dicyclohexylammonium.

18. The toner composition of claim 11, wherein said cationic amphiphilic counterion is selected from: cocoalkyltrimethylammonium, tallowalkyltrimethylammonium, hydrogenatedtallowalkyltrimethylammonium, soyalkyltrimethylammonium, benzylcocoalkyldimethylammonium, hexadecyltrimethyl-ammonium, dicocoalkyldimethylammonium, dimethyldioctadecylammonium, dimethyl(2-ethylhexyl) hydrogenatedtallowalkyl-ammonium, or dimethylditallow-ammonium.

19. The toner composition of claim 18, wherein said cationic amphiphilic counterion is dicocoalkyldimethylammonium.

20. The toner composition of claim 18, wherein said cationic amphiphilic counterion is dimethyl(2-ethylhexyl) hydrogenatedtallowalkyl-ammonium.

21. The toner composition of claim 1, wherein said amphiphilic ion is an anionic amphiphilic ion selected from: an alkyl sulfonate, an alkylbenzene sulfonate, an alkylsulfate, a sarcosine, a sulfosuccinate, an alcohol ethoxylate sulfate, an alcohol ethoxylate sulfonate, an alkyl phosphate, an alkylethoxylated phosphate, an ethoxylated alkylphenol sulfate, a fatty carboxylate, a taurate, an isethionate, an aliphatic carboxylate, or an ion derived from a polymer containing an acid group.

22. The toner composition of claim 1, wherein said amphiphilic counterion is cationic amphiphilic counterion, said counterion being an ammonium ion formed from the addition of an acid to a compound selected from: a fatty amine, an ester of an aminoalcohol, an alkylamine, a polymer containing an amine functionality, a polyethoxylated amine, a polypropoxylated amine, a polyethoxylatedpolypropoxylatedamine, an aniline, a fatty alcohol ester of amino acid, a polyamine N-alkylated with a dialkyl succinate ester, a heterocyclic amine, a guanidine derived from a fatty amine, a guanidine derived from an alkylamine, a guanidine derived from an arylamine, an amidine derived from a fatty amine, an amidine derived from a fatty acid, an amidine derived from an alkylamine, or an amidine derived from an arylamine.

23. The toner composition of claim 1, wherein said amphiphilic counterion is a cationic amphiphilic counterion selected from: dioctylammonium, oleylammonium, stearylammonium, dodecylammonium, dimethyldodecylammonium, stearylguanidinium, oleylguanidinium, soyalkylammonium, cocoalkylammonium, oleylammoniumethoxylate, protonated diethanolaminedimyristate; or N-oleyldimethylammonium.

24. The toner composition of claim 1, wherein said amphiphilic counterion is a cationic amphiphilic counterion selected from: ditallowalkylammonium, dimethyloleylammonium, cocoalkyldimethylammonium, or dimethylhydrogenatedtalloalkylammonium.

25. The toner composition of claim 1, wherein said amphiphilic counterion is cationic and is dicocoalkylammonium or dicyclohexylammonium.

26. The toner composition of claim 1, wherein said amphiphilic counterion is a cationic amphiphilic counterion represented by the formula $R_4N^+$, wherein R is independently hydrogen, $C_1$–$C_{30}$ alkyl, $C_1$–$C_{30}$ alkenyl, $C_7$–$C_{30}$ aralkyl, or $C_7$–$C_{30}$ alkaryl.

27. The toner composition of claim 26, wherein said cationic amphiphilic counterion has at least 16 carbon atoms.

28. The toner composition of claim 27, wherein said cationic amphiphilic counterion has at least 24 carbon atoms.

29. The toner composition of claim 26, wherein said cationic amphiphilic counterion is selected from: cocoalkyltrimethylammonium, tallowalkyltrimethylammonium, hydrogenatedtallowalkyltrimethylammonium, soyalkyltrimethylammonium, benzylcocoalkyldimethylammonium, hexadecyltrimethyl-ammonium, dicocoalkyldimethylammonium, dimethyldioctadecylammonium, dimethyl(2-ethylhexyl) hydrogenatedtallowalkyl-ammonium, or dimethylditallow-ammonium.

30. The toner composition of claim 1, wherein the chargeable modified pigment particles are present in an amount of from about 1% by weight to about 30% by weight of the toner composition.

31. The toner composition of claim 1, wherein said toner composition further comprises a charge control additive.

32. The toner composition of claim 1, wherein said toner composition is a magnetic toner further comprising iron oxide.

33. The toner composition of claim 32, wherein said iron oxide is magnetite.

34. The toner composition of claims 1, wherein said toner is a positively charging toner composition.

35. The toner composition of claims 1, wherein said toner is a negatively charging toner composition.

36. A developer composition comprising a toner composition of claim 1 and carrier particles.

37. The developer composition of claim 36, wherein said pigment particle is carbon black, cyan pigment, magenta pigment, yellow pigment, blue pigment, green pigment, brown pigment, violet pigment, red pigment or mixtures thereof.

38. The developer composition of claim 37, wherein said pigment particle is carbon black.

39. The developer composition of claim 36, further comprising unmodified carbon black, cyan pigment, magenta pigment, yellow pigment, blue pigment, green pigment, brown pigment, violet pigment, red pigment or mixtures thereof.

40. The developer composition of claim 36, wherein said resin particles comprise styrenic polymer-based or polyester-based resin particles.

41. The developer composition of claim 40, wherein said styrenic polymer-based resin particles are styrenated acrylic resin particles.

42. The developer composition of claim 40, wherein said styrenic polymer-based resin particles are homopolymers and copolymers of styrene and its derivatives; copolymers of styrene and acrylic acid esters; copolymers of styrene and methacrylic acid esters; multi-component copolymers of styrene, acrylic acid ester and methacrylic acid esters; or copolymers of styrene and vinyl monomers.

43. The developer composition of claim 36, wherein said ionic group is an anionic group selected from: $—C_6H_4CO_2^-$, $—C_6H_4SO_3^-$, $—C_{10}H_6CO_2^-$, $—C_{10}H_6SO_3^-$, and $—C_2H_4SO_3^-$.

44. The developer composition of claim 43, wherein the anionic group is $—C_6H_4CO_2^-$.

45. The developer composition of claim 43, wherein said anionic group $—C_6H_4SO_3^-$.

46. The developer composition of claim 43, wherein said amphiphilic counterion is cationic amphiphilic counterion, said counterion being an ammonium ion formed from the addition of an acid to a compound selected from: a fatty amine, an ester of an aminoalcohol, an alkylamine, a polymer containing an amine functionality, a polyethoxylated amine, a polypropoxylated amine, a polyethoxylatedpolypropoxylatedamine, an aniline, a fatty alcohol ester of amino acid, a polyamine N-alkylated with a dialkyl succinate ester, a heterocyclic amine, a guanidine derived from a fatty amine, a guanidine derived from an alkylamine, a guanidine derived from an arylamine, an amidine derived from a fatty amine, an amidine derived from a fatty acid, an amidine derived from an alkylamine, or an amidine derived from an arylamine.

47. The developer composition of claim 43, wherein said amphiphilic counterion is a cationic amphiphilic counterion selected from: dioctylammonium, oleylammonium, stearylammonium, dodecylammonium, dimethyldodecylammonium, stearylguanidinium, oleylguanidinium, soyalkylamnmonium, cocoalkylammonium, oleylammoniumethoxylate, protonated diethanolaminedimyristate; or N-oleyldimethylammonium.

48. The developer composition of claim 43, wherein said amphiphilic counterion is a cationic amphiphilic counterion selected from: ditallowalkylammonium, dimethyloleylammonium, cocoalkyldimethylamnonium, or dimethylhydrogenatedtalloalkylammonium.

49. The developer composition of claim 43, wherein said amphiphilic counterion is cationic and is dicocoallkylammonium or dicyclohexylammonium.

50. The developer composition of claim 43, wherein said cationic amphiphilic counterion is selected from: cocoalkyltrimethylammonium, tallowalkyltrimethylammonium, hydrogenatedtallowalkyltrimethylammonium, soyalkyltrimethylammonium, benzylcocoalkyldimethylammonium, hexadecyltrimethyl-ammonium, dicocoalkyldimethylammonium, dimethyldioctadecylammomium, dimethyl(2-ethylhexyl) hydrogenatedtallowalkyl-ammonium, or dimethylditallowammonium.

51. The developer composition of claim 50, wherein said cationic amphiphilic counterion is dicocoalkyldimethylammonium.

52. The developer composition of claim 50, wherein said cationic amphiphilic counterion is dimethyl(2-ethylhexyl) hydrogenatedtallowalkyl-ammonium.

53. The developer composition of claim 36, wherein said amphiphilic counterion is cationic amphiphilic counterion, said counterion being an ammonium ion formed from the addition of an acid to a compound selected from: a fatty amine, an ester of an aminoalcohol, an alkylamine, a polymer containing an amine functionality, a polyethoxylated amine, a polypropoxylated amine, a polyethoxylatedpolypropoxylatedamine, an aniline, a fatty alcohol ester of amino acid, a polyamine N-alkylated with a dialkyl succinate ester, a heterocyclic amine, a guanidine derived from a fatty amine, a guanidine derived from an alkylamine, a guanidine derived from an arylamine, an amidine derived from a fatty amine, an amidine derived from a fatty acid, an amidine derived from an alkylamine, or an amidine derived from an arylamine.

54. The developer composition of claim 36, wherein said amphiphilic counterion is a cationic amphiphilic counterion selected from: dioctylammonium, oleylammonium, stearylammonium, dodecylammonium, dimethyldodecylammonium, stearylguanidinium, oleylguanidinium, soyalkylammonium, cocoalkylammonium, oleylammoniumethoxylate, protonated diethanolaminedimyristate; or N-oleyldimethylammonium.

55. The developer composition of claim 36, wherein said amphiphilic counterion is a cationic amphiphilic counterion selected from: ditallowalkylammonim, dimethyloleylammonium, cocoalkyldimethylammonium, or dimethylhydrogenatedtalloalkylammonium.

56. The developer composition of claim 36, wherein said amphiphilic counterion is cationic and is dicocoalkylammonium or dicyclohexylammonium.

57. The developer composition of claim 36, wherein said amphiphilic counterion is a cationic amphiphilic counterion represented by the formula $R_4N^+$, wherein R is independently hydrogen, $C_1$–$C_{30}$ alkyl, $C_1$–$C_{30}$ alkenyl, $C_7$–$C_{30}$ aralkyl, or $C_7$–$C_{30}$ alkaryl.

58. The developer composition of claim 57, wherein said cationic amphiphilic counterion has at least 16 carbon atoms.

59. The developer composition of claim 58, wherein said cationic amphiphilic counterion has at least 24 carbon atoms.

60. The developer composition of claim 57, wherein said cationic amphiphilic counterion is selected from: cocoalkyltrimethylammonium, tallowalkyltrimethylammonium, hydrogenatedtallowalkyltrimethylammonium, soyalkyltnimethylammonium, benzylcocoalkyldimethylammonium, hexadecyltrimethyl-ammonium, dicocoalkyldimethylammonium, dimethyldioctadecylammonium, dimethyl(2-ethylhexyl) hydrogenatedtallowalkyl-ammonium, or dimethylditallow-ammonium.

61. The developer composition of claim 36, wherein the chargeable modified pigment particles are present in an amount of from about 1% by weight to about 30% by weight of the toner composition.

62. The developer composition of claim 36, wherein said toner composition further comprises a charge control additive.

63. The developer composition of claim 36, wherein the carrier particles are ferrites, steel, iron powder, or mixtures thereof.

64. A method of imaging comprising formulating an electrostatic latent image on a negatively charge photoconductive imaging member, affecting the development thereof with a toner composition of claim 1, and transferring the developed image onto a substrate.

65. The method of imaging of claim 64, wherein the transferred image is permanently fixed to the substrate.

* * * * *